US009561680B2

(12) United States Patent
Spoor et al.

(10) Patent No.: US 9,561,680 B2
(45) Date of Patent: Feb. 7, 2017

(54) SCREEN PRINTING

(75) Inventors: Peter Benjamin Spoor, Eindhoven (NL); Marinus Cornelis Petrus Dekkers, Gennep (NL); Martin Jan Smallegange, Beuningen (NL)

(73) Assignee: SPGPrints B.V., Boxmeer (NL)

( * ) Notice: Subject to any disclaimer, the term of this patent is extended or adjusted under 35 U.S.C. 154(b) by 596 days.

(21) Appl. No.: 13/384,918

(22) PCT Filed: Oct. 11, 2010

(86) PCT No.: PCT/NL2010/050671

§ 371 (c)(1),
(2), (4) Date: Mar. 13, 2012

(87) PCT Pub. No.: WO2011/046432

PCT Pub. Date: Apr. 21, 2011

(65) Prior Publication Data

US 2012/0174806 A1 Jul. 12, 2012

(30) Foreign Application Priority Data

Oct. 12, 2009 (NL) ..... 2003627

(51) Int. Cl.
*B41N 1/24* (2006.01)
*B41C 1/14* (2006.01)
*B41M 1/12* (2006.01)

(52) U.S. Cl.
CPC ..... *B41N 1/247* (2013.01); *B41C 1/14* (2013.01); *B41M 1/12* (2013.01)

(58) Field of Classification Search
CPC ..... B41N 1/247; B41C 1/14; B41C 1/142; B41M 1/12

(Continued)

(56) References Cited

U.S. PATENT DOCUMENTS 4,496,434 A 1/1985 Morssinkhof
5,939,172 A 8/1999 Snakenborg et al.

(Continued)

FOREIGN PATENT DOCUMENTS

CN 1729084 A 2/2006
CN 101203384 A 6/2008

(Continued)

OTHER PUBLICATIONS

Office Action and Search Report from Taiwan Patent Office for a Counterpart Foreign Application, Dated Jun. 22, 2013.

(Continued)

*Primary Examiner* — Jill Culler
*Assistant Examiner* — Marissa Ferguson Samreth
(74) *Attorney, Agent, or Firm* — Hoffmann & Baron, LLP

(57) ABSTRACT

A method for screen printing using a screen, preferably a metal screen made by electroforming, having a pattern of openings separated by bridges and crossing points, and having a flat surface on the squeegee side, wherein on the printing side of the screen the screen has a 3-D structure comprising peaks (P) and valleys (V) formed by a difference in thickness between the bridges and crossing points. The use of the method in the production of RFID tags, solar panels, electronic printing boards. A 3-D printing screen, with an attached stencil with or without the negative of an image to be printed. A printing machine comprising: one or more 3-D printing screens, in combination with one or more reservoirs for ink and/or in combination with a roller or squeegee.

20 Claims, 3 Drawing Sheets

Figure 1:
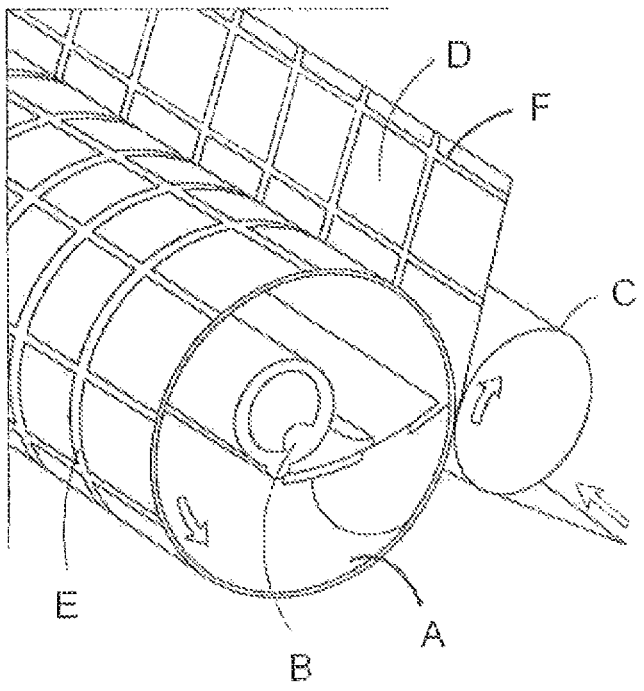
Figure 2:
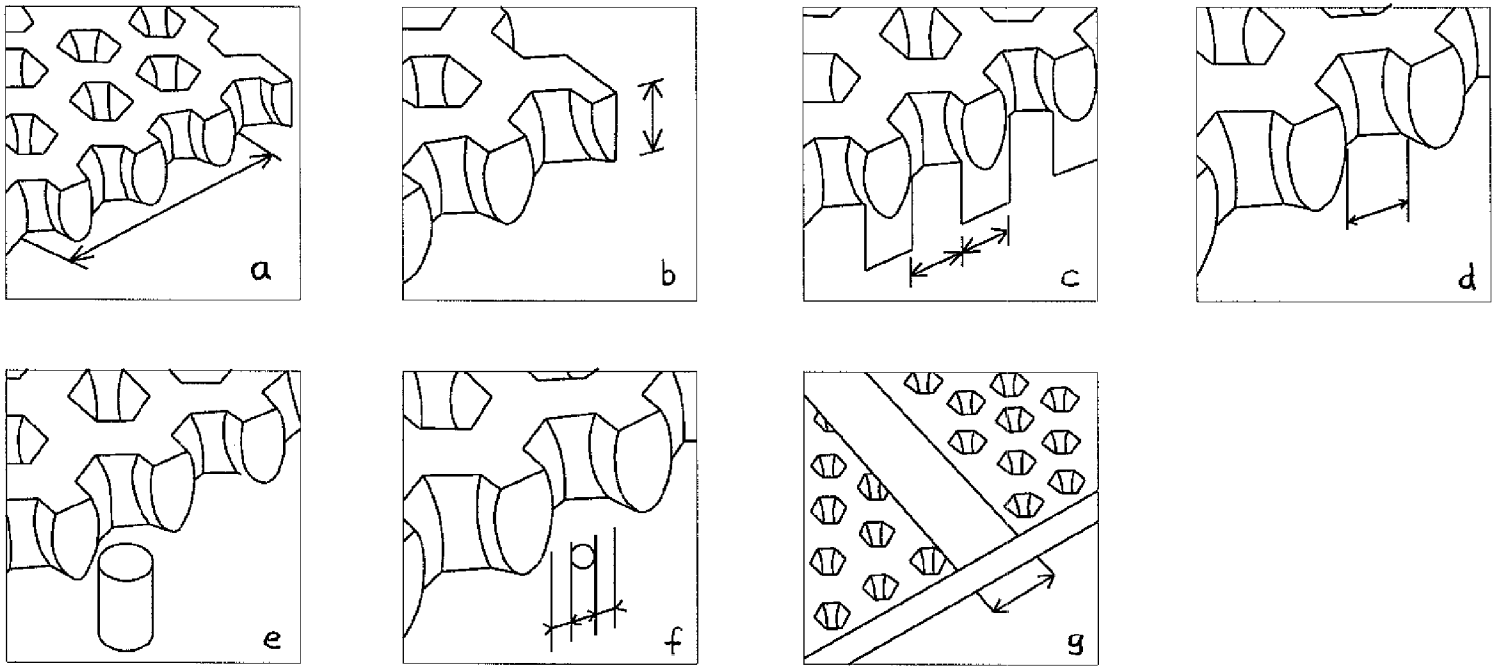
Figure 3:
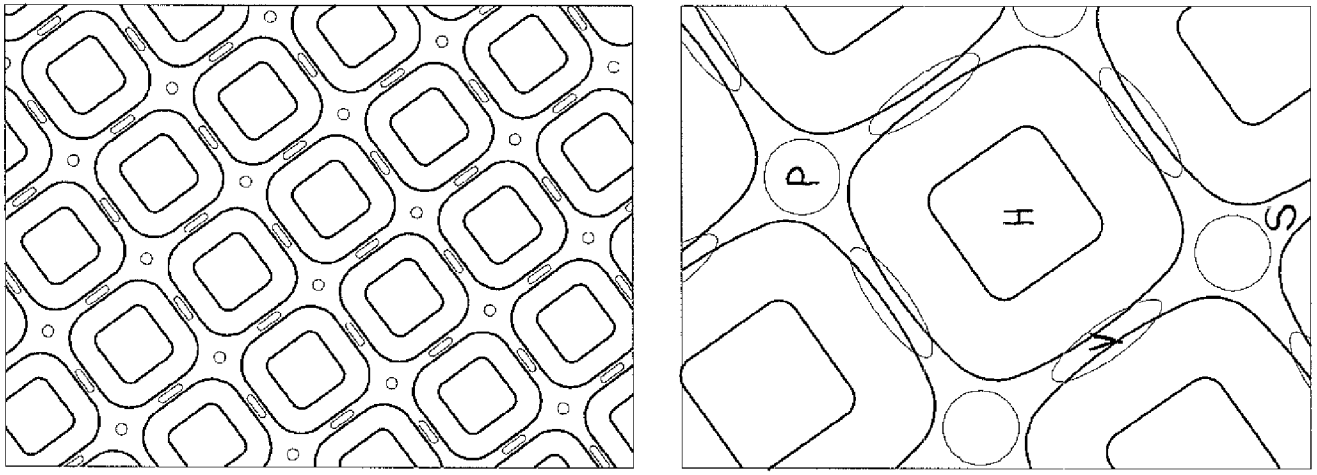

(58) Field of Classification Search
USPC ..... 101/123, 129; 428/596, 600
See application file for complete search history.

(56) References Cited

U.S. PATENT DOCUMENTS

| | | | | |
|---|---|---|---|---|
| 8,714,083 | B2 * | 5/2014 | Numauchi et al. | 101/120 |
| 2006/0141279 | A1 * | 6/2006 | Thuis et al. | 428/596 |
| 2007/0287092 | A1 * | 12/2007 | Blackenborg | 430/270.1 |
| 2008/0284313 | A1 * | 11/2008 | Berben et al. | 313/501 |
| 2009/0246896 | A1 * | 10/2009 | Kreger et al. | 438/22 |
| 2009/0314336 | A1 | 12/2009 | Nakatani et al. | |

FOREIGN PATENT DOCUMENTS

| | | | |
|---|---|---|---|
| EP | 0 862 940 | A2 | 9/1998 |
| GB | 2 201 637 | A | 9/1988 |
| TW | 547330 | U | 8/2003 |
| WO | 80/00677 | A1 | 4/1980 |
| WO | 9722434 | A1 | 6/1997 |
| WO | 2004043659 | A1 | 5/2004 |
| WO | 2010087455 | A1 | 8/2010 |

OTHER PUBLICATIONS

English Machine Translation of CN 1729084 A.
English Machine Translation of Abstract of TW 547330 U.
International Search Report for PCT/NL2010/050671 dated Jan. 6, 2011.
NL Search Report NL 2003627 dated May 27, 2010.
Translation of CN 101203384A, dated Dec. 4, 2013.
Chinese First Office Action, Filing No. 2010800345312, Applicant: Stork Prints B.V.; Title: Screen Printing, dated Nov. 4, 2013.

* cited by examiner

SCREEN PRINTING

CROSS-REFERENCE TO RELATED APPLICATIONS

This application is the National Stage of International Application No. PCT/NL2010/050671, filed Oct. 11, 2010, which claims the benefit of Netherlands Application No. 2003627, filed Oct. 12, 2009, the contents of both of which are incorporated by reference herein.

TECHNICAL FIELD

This invention concerns screen printing. More specifically, it concerns screen printing with a new type of screen, allowing the printing with a greater amount of ink and/or high resolution screen printing, allowing the printing of lines below 100 micrometer width.

BACKGROUND ART

Screen printing is a printing technique that typically uses a screen made of woven mesh to support an ink-blocking stencil. The attached stencil forms open areas of mesh that transfer ink as a sharp-edged image onto a substrate. A roller or squeegee is moved across the screen with ink-blocking stencil, forcing or pumping ink past the threads of the woven mesh in the open areas. Graphic screen-printing is widely used today to create many mass or large batch produced graphics, such as posters or display stands. Full colour prints can be created by printing in CMYK (cyan, magenta, yellow and black ('key')). Screen-printing is often preferred over other processes such as dye sublimation or inkjet printing because of its low cost and ability to print on many types of media.

A significant characteristic of screen printing is that a greater thickness of the ink can be applied to the substrate than is possible with other printing techniques. Screen-printing is therefore also preferred when ink deposits with the thickness from around 5 to 20 micrometer or greater are required which cannot (easily) be achieved with other printing techniques. This makes screen-printing useful for printing solar cells, electronics etc. (The definition of ink in this application not only includes solvent and water-based [pigmented] ink formulations but also includes [colourless] varnishes, adhesives, metallic ink, conductive ink, and the like.)

Generally, a screen is made of a piece of porous, finely woven fabric called mesh stretched over a frame of e.g. aluminium or wood. Currently most meshes are made of man-made materials such as steel. As mentioned above, areas of the screen are blocked off with a non-permeable material to form the stencil, which is a negative of the image to be printed; that is, the open spaces are areas where the ink will appear.

In the process of printing, the screen having a stencil facing the substrate is placed atop a substrate such as paper or fabric. In conventional flatbed screen printing, ink is placed on top of the screen, and a fill bar (also known as a floodbar) is used to fill the mesh openings with ink. The operator begins with the fill bar at the rear of the screen and behind a reservoir of ink. The operator lifts the screen to prevent contact with the substrate and then using a slight amount of downward force pulls the fill bar to the front of the screen. This effectively fills the mesh openings with ink and moves the ink reservoir to the front of the screen. The operator then uses a squeegee (rubber blade) to move the mesh down to the substrate and pushes the squeegee to the rear of the screen. The ink that is in the mesh opening is pumped or squeezed by capillary action to the substrate in a controlled and prescribed amount. The theoretical wet ink deposit is estimated to be equal to the thickness of the mesh and or stencil, as will be discussed hereinafter. As the squeegee moves toward the rear of the screen the tension of the mesh pulls the mesh up away from the substrate (called snap-off) leaving the ink upon the substrate surface. In rotary screen printing, the ink is typically forced from the inside of the cylindrical screen. Nowadays, this process is automated by machines.

There are three types of screen-printing presses. The 'flat-bed' (probably the most widely used), 'cylinder', and 'rotary'. Flat-bed and cylinder presses are similar in that both use a flat screen and a three step reciprocating process to perform the printing operation. The screen is first moved into position over the substrate, the squeegee is then pressed against the mesh and drawn over the image area, and then the screen is lifted away from the substrate to complete the process. With a flat-bed press the substrate to be printed is typically positioned on a horizontal print bed that is parallel to the screen. With a cylinder press the substrate is mounted on a cylinder. Stability of the image can be a problem due to the movement of the metal threads of a woven screen. On the other hand, rotary screen presses are designed for continuous, high speed web printing. The screens used on rotary screen presses are for instance seamless thin metal cylinders. The open-ended cylinders are capped at both ends and fitted into blocks at the side of the press. During printing, ink is pumped into one end of the cylinder so that a fresh supply is constantly maintained. The squeegee, for instance, is a free floating steel bar inside the cylinder and squeegee pressure is maintained and adjusted for example by magnets mounted under the press bed. Rotary screen presses are most often used for printing textiles, wallpaper, and other products requiring unbroken continuous patterns.

Screen-printing is more versatile than traditional printing techniques. The surface does not have to be printed under pressure, unlike etching or lithography, and it does not have to be planar. Screen-printing inks can be used to work with a variety of substrates, such as textiles, ceramics, wood, paper, glass, metal, and plastic. As a result, screen-printing is used in many different industries.

One of the interesting areas for screen printing is in inks that can be used to create raised images, smooth shining solid areas, or fine line patterns that appeal to both the tactile and visual senses. An improvement in respect of the quality of such printings would be rather desirable.

In particular for quality prints as indeed is the case for Braille printing, the process requires an extremely uniform relatively thick coating of ink without ghosting or streaks. It would therefore be very interesting to be able to improve the uniform deposition of increased amounts of ink on substrates, especially for finer details. This would be of interest in flatbed and cylinder screen printing and rotary printing alike.

In addition to screens made on the basis of a woven mesh based on metal threads, such as U.S. Pat. No. 3,759,799, screens have been developed out of a solid metal sheet with a grid of holes. In U.S. Pat. No. 4,383,896 or U.S. Pat. No. 4,496,434 for instance, and in subsequent patents by the current applicant, a metal screen is described comprising ribs and apertures. This screen is prepared by a process comprising of electrolytically forming a metal screen by forming in a first electrolytic bath a screen skeleton upon a matrix provided with a separating agent, stripping the formed screen skeleton from the matrix and subjecting the screen skeleton to an electrolysis in a second electrolytic bath in order to deposit metal onto said skeleton. This technique has been used to prepare metal screens for screen printing with various mesh sizes (e.g. from 75 to over 350), thicknesses (from about 50 to more than 300 micrometer), and hole diameters (from 25 micrometer and greater) and thus various amounts of open area (from about 10 to about 55%), wet ink deposits (from about 5 to more than 350 micrometer thick) and resolution (from about 90 to 350 micrometer). Indeed, these screens outperform woven screens in terms of lifetime, sturdiness and stability, resistance to wrinkling with virtually no breakages or damage during press set-up or printing. Still, it would be of interest to improve such non-woven screens in respect of greater ink deposition and sharper images. Accordingly, this is one of the aims of the current invention.

Moreover, as mentioned before, screen printing is ideal for preparing wafer-based solar PV cells. The preparation of such cells comprises printing 'fingers' and buses of silver on the front; and buses of silver printed on the back. The buses and fingers are required to transport the electrical charge. On the other hand, the buses and fingers need to take as little surface of the solar PV cells as possible, and thus tend to be relatively thick. Screen printing is ideal as one of the parameters that can be varied greatly and can be controlled fittingly is the thickness of the print.

Solar wafers are becoming thinner and larger, so careful printing is required to maintain a low breakage rate. On the other hand, high throughput at the printing stage improves the throughput of the whole cell production line.

Rotary screen-printing is typically a roll-to-roll technology, which enables continuous high volume and high speed production. Further benefits include reduced ink and chemical waste, higher ink deposits, great production flexibility (various repeat sizes and web widths), with excellent quality, repeatable results and reliable performance.

The application of electronics on common substrates such as paper, film and textile using rotary screen-printing is relatively new. Rotary screen technology enables low cost production of printed electronics, such as radio-frequency identification tags (RFID tags).

For instance, Stork Prints has designed various rotary screen printing lines especially for printed electronics applications. Their machine parts are specifically developed for high accuracy printing on (heat) sensitive substrates. For instance, the design of the PD-RSI 600/900 rotary screen printing line (Stork Prints brochure 101510907) enables the production of an entire RFID tag in one run, at a speed of over 50,000 units per hour.

However, the demands being placed on screen-printing forms for graphics and especially printed electronics applications are increasing as components become smaller and the demand for high productivity fabrication processes intensifies. Printed lines widths of less than 80 micrometer combined with high ink transfer, durable print forms and excellent repeatability are becoming increasingly common. Despite the many benefits of screen-printing with non-woven screens, and in particular with rotary screen-printing; for very high resolution printing flatbed woven screen material still provides superior resolution and sharpness. Indeed, even the use of screens with a (very) high open area, and with smaller bridges making up the mesh, prints with printed lines widths less than 100 micrometer made with rotary screen-printing can be less sharp and result in less ink-transfer than prints made using the best flat-bed woven metal screen. Thus, it would be of great interest to find an improved screen that has all the strength and durability properties of the non-woven screens such as developed by Stork Prints, but with improved sharpness and ink-transfer capabilities for the preparation of highs resolution prints. Moreover, it would be of great interest to find a non-woven screen that can be applied in rotary screen printing, where woven metal screens cannot be used.

Interestingly, both problems of improved ink deposition and sharper printing have been solved through the application of a new type of screen.

SUMMARY OF THE INVENTION

Accordingly, the invention claims a method for screen printing using a screen, preferably a metal screen made by electroforming, having a pattern of openings separated by bridges and crossing points and having a flat surface on the squeegee side, wherein on the printing side of the screen the screen has a 3-D structure comprising peaks and valleys formed by a difference in thickness between the bridges and crossing points. In addition, the invention claims a printing screen comprising the 3-D structure, with an attached stencil with or without the negative of an image to be printed. In addition the invention claims a printing machine comprising one or more printing screens according to the current invention in combination with one or more reservoirs for ink and/or in combination with a roller or squeegee.

More specifically the screen is a metal screen material with a mesh number of 150-1000 mesh, preferably 190 to 800 mesh having a flat side, comprising a network of bridges which are connected to one another by crossing points, which bridges thereby delimit the openings, the thickness of the crossing points not being equal to the thickness of the bridges on the printing side of the screen material opposite to the flat squeegee side. Preferably the difference in thickness between the bridges and the crossing points is from 5 to 100 micrometer.

BRIEF DESCRIPTION OF FIGURES IN THE DRAWINGS

The first figure is a schematic representation of the rotary screen printing principle. A is the screen. B is the squeegee. C is the impression roller. D is the substrate. E is the stencil. F is the printed image.

In the second figure schematic representations of screens according to a preferred embodiment of the invention since manufactured by electroforming may be found. These are therefore non-woven screens. Shown is a hexagonal structure of the screen opening ('honeycomb' hole formation), with so-called bridges connecting crossing points. Electroforming may also be used in the manufacture of screens with other structures; e.g., that are rectangular. Shown here (from top left to bottom right, labelled a)-g)) is the indication of the a) Mesh/linear inch; b) Thickness; c) Open area; d) Hole diameter; e) Theoretical wet ink deposit; f) Maximum particle size and g) Resolution. Mesh/linear inch is the number of openings per linear inch of a screen. Thickness is the screen thickness. Open area is the percentage of all openings in relation to the total screen area. Hole diameter is the smallest distance between the two opposite walls of the opening. Theoretical wet ink deposit is estimated using theoretical ink volume which is the volume of ink in mesh openings per unit area of substrate, calculated as: % open area×mesh thickness. It is typically reported in micrometers, or as the equivalent $cm^3/m^2$. Maximum particle size is ⅓ of the hole diameter for the best ink passage.

The third figure is a schematic representation of a photo made by optical microscope, showing the top view of the print side of rectangular screen material according to invention with a 3-D structure, wherein the hole diameter is roughly 40 micrometer. This screen (S) has rectangular hole formation (H). Also a close-up is shown. Ovals indicate the valleys (V) formed by the bridges. Circles indicate the peaks (P) formed by the crossing points.

DETAILED DESCRIPTION OF THE INVENTION

An electroforming method for making metal products having a pattern of openings separated by bridges using a mandrel in an electroplating bath is known from e.g., WO 9740213.

In the patent application WO 2004043659 a metal screen material with a 3-D surface structure is specifically proposed for use as a perforating stencil in perforating plastic films, etc, similar to the method and device known from, for example, U.S. Pat. No. 6,024,553. The 3-D surface structure is formed on just one side of the screen by the difference in thickness between the bridges and the crossing points. No teaching is provided in WO 2004043659 about the use of the claimed screen material for screen printing.

It has now been found that for printing of solid areas and raised images the new 3-D screens provide for greater ink deposition and sharper deposition.

Moreover, it has now been found that for very high resolution screen printing the new 3-D screens, with a mesh number of 150-1000 mesh, preferably 190 to 800 mesh having a flat squeegee side, and a network of peaks and valleys on the print side of the screen material, are ideal. These screens allow the printing of much finer lines when compared to a screen material without such a 3-D surface structure.

The achieved print quality is surprisingly better than that obtained with a screen with a much higher open area and smaller bridges. It is hypothesised that the 3-D surface structure, with peaks and valleys on the print side, enhances the transfer of ink through the screen and allow for the deposition of a greater amount of ink on the substrate due to the "peaks", whereas the valleys allow for the sharp deposition of the ink. This is an advantage both when depositing ink to produce solids with an even print on the substrate and/or raised images, but also when producing continuous fine lines with sharp edges. Moreover, these advantages are achieved without any major loss of screen strength, stability and durability.

The method for making the screen material is not part of this invention. Indeed, the methods known from U.S. Pat. No. 4,383,896 or U.S. Pat. No. 4,496,434 may be used to prepare a flat screen, whereas by way of forced flow conditions a 3-D structure on the print side of the screen material may be created, similar to the method disclosed in the aforementioned WO 2004043659. In addition, a metal screen material with a 3-D surface structure may be made with different techniques and with different materials. Thus, the 3-D structure may also be made by laser engraving, etching or ECM (electrochemical machining). Also within the scope of the invention is the preparation of such a screen by embossing on a polymer, or coating a mesh by CVD (chemical vapour deposition), PVD (physical vapour deposition), plasma spraying or other coating techniques. The 3-D surface structure may also be produced with a separate layer of lacquer on a screen.

The new 3-D screen may be used in flat-bed and cylinder screen-printing, and in rotary screen-printing.

For printing solid areas and raised images, a screen with a high amount of wet ink deposition (greater than 6 microns, preferably greater than 10 microns) is preferred. Herein the amount of wet ink deposition is expressed in terms of the theoretical wet ink deposition as defined previously in the present specification. Suitable screens have a mesh of 35 to 500, preferably 75 to 450. The thickness may vary from 35 to 200 micrometer, preferably from 60 to 150 micrometer. The hole diameter may vary from 10 to 650 micrometer, preferably from 15 to 400 micrometer.

For producing high resolution prints, with a resolution below 100 micrometer, a screen with a mesh number of 150-1000 mesh, preferably 190 to 800 mesh is preferred. The thickness may vary from 20 to 200 micrometer, preferably from 35 to 160 micrometer. The hole diameter may vary from 5 to 130 micrometer, preferably from 15 to 105 micrometer.

Preferably, the screen is a rotary screen.

In addition, the invention claims a printing screen comprising the 3-D structure, with an attached stencil with or without the negative of an image to be printed. This combination of 3-D screen and stencil is novel and has the inherent advantages of improved printing as set out above.

In addition the invention claims a printing machine comprising one or more 3-D printing screens according to the current invention in combination with one or more reservoirs for ink and/or in combination with a roller or squeegee.

The invention claimed is:

1. A method for high resolution screen printing an image on a substrate, using a screen having a pattern of openings separated by bridges and crossing points, the screen having a squeegee side and an opposite printing side, and having a flat surface on the squeegee side, wherein on the printing side of the screen the screen has a 3-D structure comprising peaks and valleys formed by a difference in thickness between the bridges and crossing points, and at the printing side of the screen a stencil facing the substrate, which stencil is a negative of the image to be printed, the method comprising depositing ink on the substrate through the openings of the screen and stencil, thereby forming an image having a resolution below 100 micrometer.

2. The method of claim 1, wherein the screen is made of metal and made by electroforming.

3. The method of claim 1, wherein the crossing points form the peaks, with a higher thickness than the bridges forming the valleys.

4. The method of claim 1, wherein the difference in thickness between the bridges and the crossing points is from 5 to 100 micrometer.

5. The method of claim 1, wherein a flat-bed, cylinder or rotary screen is used.

6. The method as claimed in claim 5, wherein a seamless rotary screen is used.

7. The method as claimed in claim 5, wherein the screen is a metal screen material with a mesh number of 150-1000 mesh.

8. The method as claimed in claim 7, wherein the screen is a metal screen material with a mesh number of 190-800 mesh, preferably 300-650 mesh.

9. The method of claim 1, wherein the screen has a thickness of from 20 to 200 micrometer, preferably from 35 to 160 micrometer and/or a hole diameter of the opening of from 5 to 130 micrometer, preferably from 15 to 105 micrometer.

10. The method of claim 1, wherein the printed image forms a part of an RFID tag, a solar panel, or an electronic printing board.

11. A method for screen printing raised images and/or solid areas on a substrate, using a screen having a pattern of openings separated by bridges and crossing points, the screen having a squeegee side and an opposite printing side, and having a flat surface on the squeegee side, wherein on the printing side of the screen the screen has a 3-D structure comprising peaks and valleys formed by a difference in thickness between the bridges and crossing points and at the printing side of the screen a stencil facing the substrate, which stencil is a negative of the image to be printed, the method comprising depositing ink on the substrate through the openings of the screen and stencil with an amount of wet ink deposition expressed as the theoretical wet ink deposit (estimated using theoretical wet ink volume which is the volume of ink in mesh openings per unit of area of substrate, calculated as: % open area×mesh thickness) that is greater than 6 micrometer.

12. The method as claimed in claim 11, wherein the amount of wet ink deposition expressed as the theoretical wet ink deposit (estimated using theoretical wet ink volume which is the volume of ink in mesh openings per unit of area of substrate, calculated as: % open area×mesh thickness) is greater than 10 micrometer.

13. The method of claim 11, wherein an opening is delimited by opposite walls and wherein the screen has a mesh of from 35 to 500, preferably of from 75 to 450, and/or a thickness of from 35 to 200 micrometer, preferably of from 60 to 150 micrometer, and/or a smallest distance between the two opposite walls of the opening ("hole diameter of the opening") of from 10 to 650 micrometer, preferably of from 15 to 400 micrometer.

14. The method of claim 11, wherein the screen is made of metal and made by electroforming.

15. The method of claim 11, wherein the crossing points form the peaks, with a higher thickness than the bridges forming the valleys.

16. The method of claim 11, wherein the difference in thickness between the bridges and the crossing points is from 5 to 100 micrometer.

17. The method of claim 11, wherein the printed image forms a part of an RFID tag, a solar panel, or an electronic printing board.

18. A 3-D printing screen, having a pattern of openings separated by bridges and crossing points, the screen having a squeegee side and an opposite printing side, and having a flat surface on the squeegee side, wherein the screen comprises peaks and valleys formed by a difference in thickness between the bridges and crossing points on the printing side of the screen, with an attached stencil with or without the negative of an image to be printed.

19. The 3-D printing screen as claimed in claim , made by electroforming.

20. A printing machine comprising: one or more 3-D printing screens according to claim 18, in combination with one or more reservoirs for ink and/or in combination with a roller or squeegee.

* * * * *